US011452897B2

(12) United States Patent
Breith

(10) Patent No.: US 11,452,897 B2
(45) Date of Patent: Sep. 27, 2022

(54) FIRE EXTINGUISHING COMPOSITION

(71) Applicant: FIREXO GROUP LIMITED, Amersham Buckinghamshire (GB)

(72) Inventor: David Breith, Beaconsfield Buckinghamshire (GB)

(73) Assignee: FIREXO GROUP LIMITED, Amersham Buckinghamshire (GB)

( * ) Notice: Subject to any disclaimer, the term of this patent is extended or adjusted under 35 U.S.C. 154(b) by 0 days.

(21) Appl. No.: 17/287,482

(22) PCT Filed: Oct. 11, 2019

(86) PCT No.: PCT/GB2019/052893
§ 371 (c)(1),
(2) Date: Apr. 21, 2021

(87) PCT Pub. No.: WO2020/084277
PCT Pub. Date: Apr. 30, 2020

(65) Prior Publication Data

US 2021/0379434 A1 Dec. 9, 2021

(30) Foreign Application Priority Data

Oct. 22, 2018 (GB) ..... 1817185

(51) Int. Cl.
*A62D 1/00* (2006.01)
*A62D 1/02* (2006.01)

(52) U.S. Cl.
CPC ..... *A62D 1/0064* (2013.01); *A62D 1/0042* (2013.01); *A62D 1/0085* (2013.01)

(58) Field of Classification Search
None
See application file for complete search history.

(56) References Cited

U.S. PATENT DOCUMENTS 3,409,550 A * 11/1968 Gould ..... A62D 1/0035 252/387
4,101,485 A * 7/1978 Brooks ..... A62C 3/02 260/DIG. 24
4,272,414 A * 6/1981 Vandersall ..... A62D 1/0035 252/607
4,978,460 A * 12/1990 Von Blucher ..... A62D 1/005 252/2
5,833,874 A * 11/1998 Stewart ..... A62D 1/0064 169/44
5,909,776 A * 6/1999 Stewart ..... A62C 35/10 169/26
6,379,578 B1 * 4/2002 Shiga ..... A62D 1/0071 106/18.24
8,080,186 B1 * 12/2011 Pennartz ..... A62D 1/0035 252/607
2004/0074650 A1 * 4/2004 Shiga ..... A62D 1/0071 169/5
2007/0090322 A1 * 4/2007 Yoon ..... A62D 1/00 252/2
2017/0056698 A1 * 3/2017 Pai ..... A62D 1/0042

FOREIGN PATENT DOCUMENTS

| | | | |
|---|---|---|---|
| CN | 106563241 | A | 4/2017 |
| CN | 106975193 | A | 7/2017 |
| CN | 107648786 | A | 2/2018 |
| CN | 107715363 | A | 2/2018 |
| CN | 108245819 | A | 7/2018 |
| GB | 2561610 | A | 10/2018 |
| JP | 2015061574 | A | 4/2015 |
| KR | 2017 0037417 | A | 4/2017 |
| WO | WO 2006-006829 | A1 | 1/2006 |

OTHER PUBLICATIONS

International Search Report and Written Opinion of PCT/GB2019/052893 dated Apr. 30, 2020; 9 pages.
Great Britain Search Report for patent application No. GB 1817185.0 dated Apr. 15, 2019.

* cited by examiner

*Primary Examiner* — Joseph D Anthony
(74) *Attorney, Agent, or Firm* — Squire Patton Boggs LLP (US)

(57) ABSTRACT

A fire extinguishing composition is described. The fire extinguishing composition comprises water in an amount of ≤75.0% by weight; a fire extinguishing salt in an amount of ≥15.0% by weight; and a film forming agent. Uses of the fire extinguishing composition and a fire extinguisher comprising the fire extinguishing composition are also described.

16 Claims, No Drawings

FIRE EXTINGUISHING COMPOSITION

CROSS-REFERENCE TO RELATED APPLICATIONS

This application is a national-stage filing under 37 USC 371(c) of International Application No. PCT/GB2019/052893, filed Oct. 11, 2019, which claims priority to, and the benefit of, European Patent Application GB1817185.0, filed Oct. 22, 2018, the entire contents of each of which are herein incorporated by reference in their entirety for all purposes.

FIELD OF THE INVENTION

The invention relates to a fire extinguishing composition and to a fire extinguisher comprising the fire extinguishing composition. The invention also relates to a method or use of the fire extinguishing composition. The invention further relates to a method of manufacturing the fire extinguishing composition.

BACKGROUND TO THE INVENTION

Fires can be hazardous when they become out of control and can cause serious injury or result in the loss of life. There are a variety of fire extinguishing compositions that can be used to contain and extinguish a fire. These fire extinguishing compositions may be administered by fire trained professionals using purpose designed equipment or by untrained individuals using, for example, a fire extinguisher.

A shortcoming of some fire extinguishing compositions that are available for extinguishing fires is that they do not rapidly extinguish the fire. As a result, the fire may spread before it can be brought under control through administration of the fire extinguishing composition. A large volume of the composition may be required to extinguish the fire and to reduce the heat generated by the fire to prevent it from restarting. These shortcomings can result in further damage to property or lead to injury.

Another problem with some fire extinguishing compositions is that they can only be used with fires of a certain type. Use of a fire extinguishing composition with the wrong type of fire can be dangerous because it can exacerbate the fire. By way of illustration, water should not be used to extinguish electrical fires or fires caused by burning oils or fats. In some instances, individuals that have not been fire trained have caused further damage or been injured by using the wrong type of fire extinguisher when attempting to put out a fire.

SUMMARY OF THE INVENTION

The invention provides a fire extinguishing composition comprising:

- water in an amount of ≤75.0% by weight;
- a fire extinguishing salt in an amount of about ≥15.0% by weight; and
- a film forming agent.

The inventors have developed an advantageous fire extinguishing composition. This composition can be used to rapidly extinguish fires. Fires may be extinguished using a relatively low quantity of the fire extinguishing composition, particularly when compared to other types of fire extinguishing composition. The fire extinguishing composition of the invention may be used to extinguish a variety of types of fire. It may be used to extinguish fires where there are multiple different sources of the fire. It may be used to extinguish the fire from several different types of source or to extinguish the fire from a single source without exacerbating the fire from other different types of sources.

The invention also provides a fire extinguisher comprising a container. The container comprises a fire extinguishing composition in accordance with the invention.

The invention further relates to a method of manufacturing a fire extinguishing composition. The method comprises mixing a fire extinguishing salt and a film forming agent in water, such that the fire extinguishing composition comprises water in an amount of ≤75.0% by weight and the fire extinguishing salt in an amount of ≥15.0% by weight.

The invention also provides a method of extinguishing a fire. The method comprises administering or applying to the fire a fire extinguishing composition in accordance with the invention.

The invention also relates to the use of the fire extinguishing composition to extinguish a fire and/or to reduce or prevent a fire from spreading.

DETAILED DESCRIPTION OF THE INVENTION

The fire extinguishing composition of the invention comprises water. The water may dissolve the fire extinguishing salt to ensure that the composition is free flowing, whether in the form of a liquid, a powder or a foam. The water also provides a liquid vehicle to assist with delivery of the composition to a fire, such as from a pressurised cannister, and to coat the surface on fire. The water may assist with extinguishing a fire, as in a water fire extinguisher, although this is not its primary role.

The fire extinguishing composition comprises water in an amount of less than or equal to 75% by weight. When a significant quantity of water is present, then the fire extinguishing composition behaves like a traditional water fire extinguisher. Water fire extinguishers cannot be used to extinguish electrical fires or fires caused by an oil, a fat or a flammable metal (e.g. lithium, potassium, magnesium, titanium or zirconium). The fire extinguishing composition of the invention may be used in the presence of electrical items and may, for example, satisfy safety standards that regulate the use of fire extinguishing compositions for use with live electrical fires.

Any reference as used herein to "% by weight", unless the context indicates otherwise, relates to a % by weight of the fire extinguishing composition.

The fire extinguishing composition typically comprises water in an amount of ≤70.0% by weight, preferably <70.0% by weight (e.g. <69.0% by weight). More preferably, the amount of water is ≤65.0% by weight, such as ≤60.0% by weight.

It is preferred that the fire extinguishing composition comprises water in an amount ≥35.0% by weight, more preferably ≥40.0% by weight, such as ≥45.0% by weight, and even more preferably ≥50.0% by weight. A sufficient amount of water should be included to dissolve the fire extinguishing salt component(s). The dissolution of the fire extinguishing salt component(s) may be aided by other components of the fire extinguishing composition.

Thus, the amount of water is typically from 35.0 to 75.0% by weight, preferably from 40.0 to 70.0% by weight, such as 45.0 to 65.0% by weight, and more preferably 50.0 to 60.0% by weight.

The fire extinguishing composition of the invention comprises a fire extinguishing salt. The fire extinguishing salt is of the type used in powder fire extinguishers known in the art. The fire extinguishing salt is used to coat or blanket the fuel with an inert solid, which smothers the fire. It may also remove heat from the fire. For a live electrical fire, the fire extinguishing salt may suppress the conductivity of the wiring. Such salts are not used in combination with water because water can, for example, exacerbate electrical fires or fires caused by an oil, a fat or a flammable metal.

The fire extinguishing composition comprises the fire extinguishing salt in an amount of ≥15% by weight. It is preferred that the amount of fire extinguishing salt is ≥20% by weight, more preferably ≥25% by weight, such as ≥30% by weight, and even more preferably ≥35% by weight. For the avoidance of doubt, the amount refers to the total amount of fire extinguishing salt. A sufficient amount of fire extinguishing salt should be present in the composition to extinguish a fire.

In general, the fire extinguishing composition comprises the fire extinguishing salt in an amount of ≤60.0% by weight, such as ≤55.0% by weight, preferably ≤50.0% by weight, and even more preferably ≤45.0% by weight. It can be difficult to dissolve the fire extinguishing salt in water if too much of the salt is present in the composition. This can affect the physical form of the fire extinguishing composition and may reduce its liquid flow characteristics.

Thus, the total amount of fire extinguishing salt is typically 20.0 to 60.0% by weight, preferably 25.0 to 55.0% by weight, such as 30.0 to 50.0% by weight, and even more preferably 35.0 to 45.0% by weight.

Typically, the fire extinguishing salt comprises a phosphate salt. The phosphate salt may be a sodium phosphate salt, an ammonium phosphate salt or an iron phosphate salt. It is preferred that the phosphate salt is an ammonium phosphate salt.

The sodium phosphate salt may be selected from trisodium phosphate ($Na_3PO_4$), sodium hydrogen phosphate ($Na_2HPO_4$), sodium dihydrogen phosphate ($NaH_2PO_4$), monosodium diphosphate ($NaH_3P_2O_7$), disodium diphosphate ($Na_2H_2P_2O_7$), trisodium diphosphate ($Na_3HP_2O_7$), tetrasodium diphosphate ($Na_4P_2O_7$), sodium triphosphate ($Na_5P_3O_{10}$), sodium trimetaphosphate ($Na_3P_3O_9$) and a mixture of two or more thereof.

The ammonium phosphate salt may be selected from diammonium phosphate ($(NH_4)_2HPO_4$), monoammonium phosphate ($NH_6PO_4$), ammonium polyphosphate ($[NH_4PO_3](OH_2)$) and a mixture of two or more thereof. It is preferred that the ammonium phosphate salt is monoammonium phosphate ($NH_4H_2PO_4$).

The iron phosphate salt may be selected from iron (II) phosphate ($Fe_3(PO_4)_2$), iron (III) phosphate ($FePO_4$) and a mixture thereof. It is preferred that the iron phosphate salt is ferric phosphate (e.g. iron (III) phosphate ($FePO_4$)).

In general, the phosphate salt is not typically a polyphosphate salt. The term "polyphosphate" in this context refers to a salt of a polymeric oxyanion formed from at least three, preferably at least four, tetrahedral $PO_4$ (phosphate) structure units linked together by sharing oxygen atoms.

When the fire extinguishing salt comprises a phosphate salt, then typically the amount of phosphate salt is 20.0 to 50.0% by weight, preferably 25.0 to 47.5% by weight, such as 27.5 to 45.0% by weight, and even more preferably 30.0 to 42.5% by weight (e.g. 30.0 to 40.0% by weight).

The fire extinguishing salt typically comprises a sulphate salt. The sulphate salt may be sodium sulphate ($Na_2SO_4$) or ammonium sulphate ($(NH_4)_2SO_4$). It is preferred that the sulphate salt is ammonium sulphate.

When the fire extinguishing salt comprises a sulphate salt, then typically the amount of sulphate salt is 2.5 to 15.0% by weight, preferably 4.0 to 12.5% by weight, such as 5.0 to 10.0% by weight, and even more preferably 5.5 to 8.0% by weight (e.g. 6.0 to 7.5% by weight).

It is preferred that fire extinguishing salt comprises a phosphate salt and a sulphate salt, such as a mixture of a phosphate salt and a sulphate salt.

In general, the fire extinguishing salt or the fire extinguishing composition does not include a hydrogen carbonate salt, such as a hydrogen carbonate (e.g. $HCO_3^-$) salt selected from sodium hydrogen carbonate ($NaHCO_3$), potassium hydrogen carbonate ($KHCO_3$) and ammonium hydrogen carbonate ($NH_4HCO_3$). The fire extinguishing composition of the invention does not require the inclusion of a hydrogen carbonate salt as an active ingredient (e.g. a fire extinguishing salt) to provide excellent performance.

The fire extinguishing composition also comprises a film forming agent. The film forming agent can form a film or coating over the surface of a liquid or objects that are on fire. This film or coating assists with cooling and extinguishing the fire. The film forming agent lowers the surface tension of the composition.

The film forming agent may comprise, or consist of, a fluorinated surfactant. A fluorinated surfactant is typically an organofluorine compound having one or more fluorine atoms, which is a surfactant. A surfactant typically comprises a hydrophobic group (e.g. tail) and a hydrophilic group (e.g. head). The fluorinated surfactant may be of the type used in an aqueous film forming foam (AFFF) extinguisher.

The fire extinguishing composition typically includes the film forming agent in an amount of from 0.05 to 5.0% by weight, such as 0.10 to 5.0% by weight. It is preferred that the fire extinguishing composition includes the film forming agent in an amount of 0.50 to 5.0% by weight, particularly 0.75 to 5.0% by weight, such as 1.0 to 5.0% by weight. Even more preferably the fire extinguishing composition includes the film forming agent in an amount of 0.75 to 2.5% by weight, such as 1.0 to 2.5% by weight.

The fluorinated surfactant may be an acid or a salt thereof, where the acid is selected from perfluorooctanoic acid (PFOA), perfluorooctane sulfonic acid (PFOS), perfluorohexanoic acid (PFHA), perfluorohexane sulfonic acid (PFHxS), perfluorononanoic acid (PFNA), perfluorononane sulfonic acid, perfluorodecanoic acid (PFDA) and perfluorodecane sulfonic acid. It is preferred that the fluorinated surfactant is perfluorohexanoic acid (PFHA), perfluorohexane sulfonic acid (PFHxS), perfluorononanoic acid (PFNA), perfluorononane sulfonic acid, perfluorodecanoic acid (PFDA), perfluorodecane sulfonic acid or a salt thereof. More preferably, the fluorinated surfactant is perfluorohexanoic acid (PFHA) or perfluorohexane sulfonic acid (PFHxS).

Surfactants comprising perfluorooctyl moieties have been shown to be environmentally persistent and may accumulate in the livers of animals. Regulations in some countries restrict or prevent the use of such surfactants in fire extinguishing compositions.

In general, the fluorinated surfactant may be a partially fluorinated surfactant. It is preferred that the fluorinated surfactant is a partially fluorinated surfactant. A partially fluorinated surfactant does not have a fluorine substituent at every position of, for example, the head or tail (e.g. the organic chain forming the surfactant).

It may be preferable that the fluorinated surfactant is a C6 fluorosurfactant.

Generally, the fluorinated surfactant may be a betaine surfactant or an amine oxide surfactant.

The fluorinated surfactant typically provides water or an aqueous solution with a surface tension of ≤35 mN/m at 25° C. when used in an amount of 0.1% by weight, preferably ≤25 mN/m, more preferably ≤20 mN/m. For example, the fluorinated surfactant may provide water or an aqueous solution with a surface tension of from 15 to 20 mN/m at 25° C. when used in an amount of 0.1% by weight. The surface tension can be measured using conventional methods, such as by using a surface tensiometer and the Wilhelmy plate method.

The fluorinated surfactant may have a density at 20° C. of from 1.01 to 1.25 g/mL, preferably 1.02 to 1.20 g/mL, more preferably 1.03 to 1.15 g/mL (e.g. 1.07 to 1.10 g/mL).

The fire extinguishing composition may further comprise an alcohol or a polyether, preferably an alcohol. The alcohol or the polyether may assist in solubilising the fire extinguishing salt in water and/or may assist in the forming or stabilising a foam.

When the fire extinguishing composition comprises a polyether, then the amount of polyether is typically from 0.01 to 0.25% by weight, preferably 0.05 to 0.20% by weight, more preferably 0.10 to 0.15% by weight.

When the fire extinguishing composition comprises an alcohol, then the amount of alcohol is typically from 0.01 to 0.75% by weight, preferably 0.05 to 0.65% by weight, such as 0.15 to 0.55% by weight, and more preferably 0.30 to 0.45% by weight.

The polyether may be selected from an ethylene glycol monoalkyl ether, a diethylene glycol monoalkyl ether, a propylene glycol monoalkyl ether, a dipropylene glycol monoalkyl ether, a triethylene glycol monoalkyl ether and a combination of two or more thereof.

The alcohol may be selected from ethylene glycol, propylene glycol, 1-butoxyethoxy-2-propanol, 2-(2-butoxyethoxy)-ethanol, glycerine, hexylene glycol, polyethylene glycol and a combination of two or more thereof. It is preferred that the alcohol is hexylene glycol and/or 2-(2-butoxyethoxy)-ethanol.

When the fire extinguishing composition comprises 2-(2-butoxyethoxy)-ethanol, then the amount of 2-(2-butoxyethoxy)-ethanol is typically from 0.10 to 0.50% by weight, preferably 0.15 to 0.40% by weight, more preferably 0.20 to 0.30% by weight. 2-(2-butoxyethoxy)-ethanol may assist with preserving the fire extinguishing composition.

When the fire extinguishing composition comprises a hexylene glycol, then the amount of hexylene glycol is typically from 0.01 to 0.25% by weight, preferably 0.05 to 0.20% by weight, more preferably 0.10 to 0.15% by weight.

The fire extinguishing composition may comprise a preservative. The preservative may be a biocide (e.g. fungicide or anti-microbial).

The preservative may be selected from 5-chloro-2-methyl-2H-isothiazol-3-one, 2-methyl-2H-isothiazol-3-one, 4-chloro-2-[(5-chloro-2-hydroxyphenyl)methyl]phenol and a combination of two or more thereof. It is preferred that the preservative is 5-chloro-2-methyl-2H-isothiazol-3-one and/or 2-methyl-2H-isothiazol-3-one.

Typically, the amount (i.e. total amount) of preservative is 0.05 to 0.60% by weight, preferably 0.10 to 0.50% by weight, more preferably 0.30 to 0.40% by weight.

The fire extinguishing composition may further comprise a non-ionic surfactant. The non-ionic surfactant is preferably an alkyl polyglycoside. The non-ionic surfactant may be included in the composition to enhance foam formation and/or to stabilise any foam that is formed. For the avoidance of doubt, the non-ionic surfactant is different (i.e. different compound) to the fluorinated surfactant.

When the fire extinguishing composition comprises a non-ionic surfactant, then the amount of non-ionic surfactant is typically from 0.005 to 0.05% by weight, preferably 0.01 to 0.03% by weight.

The fire extinguishing composition may further comprise a foaming agent. The foaming agent is preferably an alkyl sulphate, such as a sodium salt of an alkyl sulphate.

When the fire extinguishing composition comprises a foaming agent, such as an alkyl sulphate, then the amount of foaming agent is typically from 0.005 to 0.05% by weight, preferably 0.01 to 0.03% by weight.

The fire extinguishing composition may be a liquid. The liquid may be a foamable composition.

Typically, the fire extinguishing composition has a specific gravity (with reference to water at, for example, 20° C.) of from 1.05 to 1.30, such as 1.10 to 1.25.

The fire extinguishing composition may be a powder or a foam.

The invention also relates to a fire extinguisher comprising a container. The container comprises the fire extinguishing composition.

The container may be a pressurised cannister. The pressurised cannister may have a nozzle for administering or applying the fire extinguishing composition.

The pressurised cannister may comprise a propellant, such as carbon dioxide or nitrogen, preferably nitrogen.

When the container is portable, the fire extinguisher may be a hand-held fire extinguisher.

The container may be part of a vehicle, such as a tank of a road vehicle for fighting fires or the cargo hold of an aerial vehicle for fighting fires. The fire extinguisher may be a fire extinguisher ball or bomb.

The invention also provides a method of manufacturing a fire extinguishing composition. The fire extinguishing composition can be prepared using conventional methods.

The method may involve adding a fire extinguishing salt to water (e.g. to form a mixture), and then adding a film forming agent to the mixture. Alternatively, the method may involve adding a film forming agent to water, and then adding a fire extinguishing salt to the mixture.

The invention provides a method of extinguishing a fire. The method comprises administering or applying the fire extinguishing composition to a fire. The fire extinguishing composition can be administered or applied in the same way as a conventional foam fire extinguisher or a powder fire extinguisher, depending on the form of the fire extinguishing composition of the invention.

The invention also relates to the use of the fire extinguishing composition to extinguish a fire and/or to reduce or prevent a fire from spreading.

The amount of fire extinguishing composition needed to extinguish a fire or to reduce or prevent a fire from spreading will depend upon the nature and extent of the fire. The fire extinguishing composition of the invention may rapidly extinguish the fire using a relatively low quantity of the composition, particularly when compared to conventional fire extinguishing compositions.

The fire may be a class A fire, a class B fire, a class C fire, a class D fire, a class K fire or a combination thereof. The fire is typically a class A fire and/or a class B fire.

The term "class A fire" as used herein refers to a fire caused by the burning of a solid combustible material.

Examples of solid combustible materials include wood, paper, charcoal, plastic and textiles.

The term "class B fire" as used herein refers to a fire caused by the burning of a flammable liquid. Examples of flammable liquids include diesel, gasoline, petroleum greases, tars, solvents or alcohols.

The term "class C fire" as used herein refers to a fire caused by an electrically energised object, such as an electrical appliance.

The term "class D fire" as used herein refers to a fire caused by a combustible metal, such as lithium, sodium, magnesium, uranium and titanium.

The term "class K fire" refers to a fire caused by cooking oils or fats, such as typically found in a kitchen.

The above classification is used in the US. Europe uses a similar classification, except that (i) electrical fires (class C fire in the US) do not have a classification in Europe (electrical fires were previously categorised as a class E fire), (ii) class C in Europe is a separate classification for fires caused by flammable gases (class B in the US), and (iii) fires caused by cooking oils or fats (class K in the US) are class F fires.

Any reference to "comprising" as used herein embraces the semi-closed term "consisting essentially of" and the closed term "consisting of".

EXAMPLES

The invention will now be illustrated by the following non-limiting examples.

Example 1

In this Example, the fire extinguishing compositions shown in Table 1 were prepared (amounts shown in % by weight).

A mixture of petrol and diesel was placed in a tray and the mixture was ignited to produce a Class B fire. The compositions were then used to put out the flames. The fire-extinguishing properties of the compositions tested were compared to those of a conventional dry powder fire extinguisher and a conventional AFFF extinguisher, which were obtained from Chubb™. The performance results for the conventional AFFF and powder fire extinguishers were similar. The comparative results shown in Table 1 are for the powder fire extinguisher. As can be seen from Table 1, compositions A to D performed worse than the conventional dry powder fire extinguisher. However, compositions 1 to 6 were superior to the conventional dry powder.

Example 2

Some of the compositions in Table 1 were also tested against a wooden crib fire. Specifically, wooden crib fires lit according to the British BS5852 (Crib 5) Test to produce a Class A fire. The compositions were then used to put out the flames. The fire-extinguishing properties of the compositions tested were compared to the fire-extinguishing properties of a conventional dry powder fire extinguisher obtained from Chubb™. As can be seen from Table 1, compositions 1 to 6 were superior to the conventional dry powder.

Example 3

In this Example, the fire extinguishing compositions shown in Table 2 were prepared (amounts shown in % by weight).

A mixture of petrol and diesel was placed in a tray and the mixture was ignited to produce a Class B fire. The compositions were then used to put out the flames and the time taken to extinguish the fires was recorded for each of the tested compositions. Five seconds after the fire was extinguished, the temperature of the fuel tray was also recorded. As can be seen from Table 2, the compositions extinguished the fires in 3 seconds. Furthermore, the fuel trays had cooled to 34 degrees C. five seconds after the fires had been extinguished.

Example 4

The compositions shown in Table 2 were tested against a wooden crib fire. Specifically, wooden crib fires lit according to the British BS5852 (Crib 5) Test to produce a Class A fire. The compositions were then used to put out the flames. The time taken to extinguish the fires was recorded for each of the tested compositions. Five seconds after the fire was extinguished, the temperature of the remnants of the wooden cribs (i.e. the ash bed) was also recorded. As can be seen from Table 2, the compositions extinguished the fires in 5 seconds. Furthermore, the ash bed had cooled to 64 degrees C. five seconds after the fires had been extinguished.

TABLE 1

| | A | B | C | D | 1 | 2 | 3 | 4 | 5 | 6 |
|---|---|---|---|---|---|---|---|---|---|---|
| Water | 89.13 | 86.12 | 83.11 | 80.05 | 65.11 | 62.3 | 59.55 | 56.28 | 44.1 | 41 |
| Phosphate (expressed as ammonium salt) | 7.50 | 10 | 12.5 | 15 | 27.5 | 30 | 32.5 | 35 | 45 | 47.5 |
| Sulphate (expressed as ammonium salt) | 2.50 | 3 | 3.5 | 4 | 5.75 | 6 | 6.25 | 6.5 | 7.5 | 8 |
| Hexylene Glycol | 0.05 | 0.06 | 0.07 | 0.08 | 0.1 | 0.11 | 0.11 | 0.12 | 0.14 | 0.14 |
| 5-Chloro-2-methyl-2H-isothiazol-3-one | 0.10 | 0.10 | 0.10 | 0.10 | 0.15 | 0.15 | 0.15 | 0.15 | 0.20 | 0.25 |
| 2-Methyl-2H-isothiazol-3-one | 0.10 | 0.10 | 0.10 | 0.10 | 0.15 | 0.15 | 0.15 | 0.15 | 0.20 | 0.25 |
| 2-(2-Butoxyethoxy)ethanol | 0.10 | 0.10 | 0.10 | 0.15 | 0.20 | 0.25 | 0.25 | 0.25 | 0.30 | 0.30 |
| Fluorinated surfactant | 0.50 | 0.50 | 0.50 | 0.50 | 1.00 | 1.00 | 1.00 | 1.50 | 2.50 | 2.50 |
| Alkyl polglycoside | 0.01 | 0.01 | 0.01 | 0.01 | 0.02 | 0.02 | 0.02 | 0.025 | 0.03 | 0.03 |
| Alkyl sulphate sodium salt | 0.01 | 0.01 | 0.01 | 0.01 | 0.02 | 0.02 | 0.02 | 0.025 | 0.03 | 0.03 |
| Petrol & Diesel Fuel Tray | Poor | Poor | Poor | Poor | 8's Faster | 10's Faster | 12's Faster | 12's Faster | 13's Faster | 13's Faster |
| Wooden Crib to BSI Spec | N/A | N/A | N/A | N/A | 5's Faster | 8's Faster | 12's Faster | 12's Faster | 13's Faster | 13's Faster |

TABLE 2

| | 7 | 8 | 9 | 10 | 11 | 12 | 13 | 14 | 15 | 16 |
|---|---|---|---|---|---|---|---|---|---|---|
| Water | 62.31 | 61.66 | 61.01 | 60.41 | 59.8 | 58.67 | 58.09 | 57.54 | 56.89 | 56.29 |
| Phosphate (expressed as ammonium salt) | 30.5 | 31 | 31.5 | 32 | 32.5 | 33.5 | 34 | 34.5 | 35 | 35.5 |
| Sulphate (expressed as ammonium salt) | 5.75 | 5.85 | 5.95 | 6 | 6.05 | 6.13 | 6.15 | 6.25 | 6.25 | 6.3 |
| Hexylene Glycol | 0.10 | 0.10 | 0.10 | 0.10 | 0.11 | 0.11 | 0.12 | 0.12 | 0.12 | 0.12 |
| 5-Chloro-2-methyl-2H-isothiazol-3-one | 0.15 | 0.15 | 0.15 | 0.15 | 0.15 | 0.15 | 0.15 | 0.15 | 0.15 | 0.15 |
| 2-Methyl-2H-isothiazol-3-one | 0.15 | 0.15 | 0.15 | 0.15 | 0.15 | 0.15 | 0.15 | 0.15 | 0.15 | 0.15 |
| 2-(2-Butoxyethoxy)ethanol | 0.25 | 0.25 | 0.25 | 0.25 | 0.25 | 0.25 | 0.25 | 0.25 | 0.25 | 0.25 |
| Fluorinated surfactant | 0.75 | 0.8 | 0.85 | 0.9 | 0.95 | 1 | 1.05 | 1.00 | 1.15 | 1.2 |
| Alkyl polglycoside | 0.02 | 0.02 | 0.02 | 0.02 | 0.02 | 0.02 | 0.02 | 0.02 | 0.02 | 0.02 |
| Alkyl sulphate sodium salt | 0.02 | 0.02 | 0.02 | 0.02 | 0.02 | 0.02 | 0.02 | 0.02 | 0.02 | 0.02 |
| Petrol & Diesel Fuel Tray (Time to Extinguish [s]) | 3 | 3 | 3 | 3 | 3 | 3 | 3 | 3 | 3 | 3 |
| Wooden Crib to BSI Spec (Time to Extinguish [s]) | 5 | 5 | 5 | 5 | 5 | 5 | 5 | 5 | 5 | 5 |
| Surface Temp [° C.]—Fuel Tray (5's after extinguish) | 34 | 34 | 34 | 34 | 34 | 34 | 34 | 34 | 34 | 34 |
| Surface Temp [° C.]—Wooden Crib (5's after extinguish) | 64 | 64 | 64 | 64 | 64 | 64 | 64 | 64 | 64 | 64 |

The invention claimed is:

1. A fire extinguishing composition comprising:

(a) water in an amount of 35.0 to 75.0% by weight;

(b) a fire extinguishing salt in an amount of ≥25.0% by weight, wherein the fire extinguishing salt comprises a phosphate salt and a sulphate salt, wherein the phosphate salt is in an amount of 20.0 to 50.0% by weight and the sulphate salt is in an amount of 5.0 to 10.0% by weight; and (c) a film forming agent in an amount of from 0.05 to 5.0% by weight, wherein the film forming agent comprises a fluorinated surfactant.

2. The fire extinguishing composition according to claim 1, wherein the film forming agent comprises a partially fluorinated surfactant.

3. The fire extinguishing composition according to claim 1, wherein the phosphate salt is monoammonium phosphate.

4. The fire extinguishing composition according to claim 1, wherein the phosphate salt is in an amount of 30.0 to 42.5% by weight.

5. The fire extinguishing composition according to claim 1, wherein the sulphate salt is ammonium sulphate.

6. The fire extinguishing composition according to claim 1, wherein the sulphate salt is in an amount of 5.5 to 8.0% by weight.

7. The fire extinguishing composition according to claim 1, which comprises an alcohol.

8. The fire extinguishing composition according to claim 7, wherein the alcohol is in an amount of from 0.01 to 0.75% by weight.

9. The fire extinguishing composition according to claim 1, which comprises a preservative.

10. The fire extinguishing composition according to claim 1, which comprises a non-ionic surfactant.

11. The fire extinguishing composition according to claim 1, which comprises a foaming agent.

12. The fire extinguishing composition according to claim 1, which is foam.

13. A fire extinguisher comprising a container, wherein the container comprises the fire extinguishing composition according to claim 1.

14. The fire extinguisher according to claim 13, wherein the container is a pressurized cannister comprising a propellant.

15. A method of extinguishing a fire comprising:

administering a fire extinguishing composition as defined in claim 1 to the fire.

16. The method according to claim 15, wherein the fire is caused by the burning of a solid combustible material and/or the burning of a flammable liquid.

* * * * *